US005217258A

United States Patent [19]

Sanderson

[11] Patent Number: 5,217,258

[45] Date of Patent: Jun. 8, 1993

[54] DOUBLE SIDED BREAK OPEN GAME TICKET

[75] Inventor: John H. Sanderson, Manitoba, Canada

[73] Assignee: Pollard Banknote Limited, Winnipeg, Canada

[21] Appl. No.: 872,132

[22] Filed: Apr. 22, 1992

[51] Int. Cl.[5] ..... B42D 15/00

[52] U.S. Cl. ..... 283/105; 283/903

[58] Field of Search ..... 283/105, 903

[56] References Cited

U.S. PATENT DOCUMENTS

| | | | |
|---|---|---|---|
| 3,940,124 | 2/1976 | Johnsen | 283/903 X |
| 4,033,611 | 7/1977 | Johnsen | 283/903 X |
| 5,098,131 | 3/1992 | Tucker | 283/105 |
| 5,141,254 | 8/1992 | Ring | 283/105 |
| 5,167,429 | 12/1992 | Casale et al. | 283/105 |

*Primary Examiner*—Paul A. Bell

*Attorney, Agent, or Firm*—Adrian D. Battison; Stanley G. Ade; Murray E. Thrift

[57] ABSTRACT

A break open game ticket comprises a first and second substrate laid back to back. Each substrate includes an upper half which includes information concerning winning combinations of symbols and a lower half which includes three break open panels. One substrate is inverted relative to the other substrate so that the panels of one are aligned with and overlie the information section of the other thus keeping the panels entirely separate. The panels on one side can therefore be opened to expose the combinations printed on the backside of the information area of the other substrate. The games are thus independant and provide a novelty effect improving the pleasure of the game player.

9 Claims, 1 Drawing Sheet

DOUBLE SIDED BREAK OPEN GAME TICKET

BACKGROUND OF THE INVENTION

This invention relates to a double sided break open game ticket.

Break open game tickets are used in an instant lottery type game in which the player purchases a ticket and breaks or tears open a panel on the ticket to reveal printed information comprising a plurality of symbols which are generally of the type used in gambling slot machines such as representations of fruit, playing card suits and lucky symbols. The ticket further includes printed information which indicates which combinations of the symbols are winning combinations. The player then compares the symbols revealed by tearing open the panel with the information relating to the winning combinations to determine whether that player has in this particular card a winning card or a losing card. The information generally also designates the amount of the winnings and so the winning ticket can be immediately redeemed by an authorized operator.

Instant lottery tickets of this type are extremely popular and any modification which provides a novelty value or an enhanced pleasure to the player can significantly increase sales of the tickets.

One modification of this type which provides a novelty effect is that of providing two games on one game ticket. Attempts have been made therefore to provide a game ticket in which on one side there is a first game and when the ticket is reversed to view the opposed side there is a second game independant of the first game. However such attempts have been seriously deficient in that the panels or break open areas on one side have been aligned directly with the panels or break open areas on the second side so that the player when breaking open the first side also reveals the information on the second side since the symbols must be printed on the rear side of the panel itself. This leads to a confusing and less pleasurable ticket for the player.

SUMMARY OF THE INVENTION

It is one object of the present invention, therefore, to provide an improved break open game ticket having two separate games on the same ticket.

According to the invention, therefore there is provided a break open game ticket comprising a first planar substrate and a second planar substrate, the substrates being attached back face to back face so as to present front faces with the front face of one substrate being on one side of the ticket and the front face of the other substrate being on an opposed side of the ticket, each substrate having on the front face thereof a first area and a second area, the first area containing printed information defining those combinations of symbols which constitute a winning ticket, the second area containing a plurality of break open panels, each break open panel comprising a portion of the respective substrate which is separated from a remaining part of the substrate by tearable side edges allowing the panel to normally lie flat in a common plane of the substrate and to be manually torn open by a player of the game ticket to fold outwardly from the common plane, the first substrate being oriented and arranged relative to the second substrate such that the second area of the first substrate overlies the back face of the first area of the second substrate and such that the second area of the second substrate overlies the backface of the first area of the first substrate, the back face of the first area of each of the first and second substrates having printed thereon a plurality of combinations of symbols for viewing by the player of the game ticket, each combination being revealed by said tearing open of a respective one of the panels of the other of the first and second substrates.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
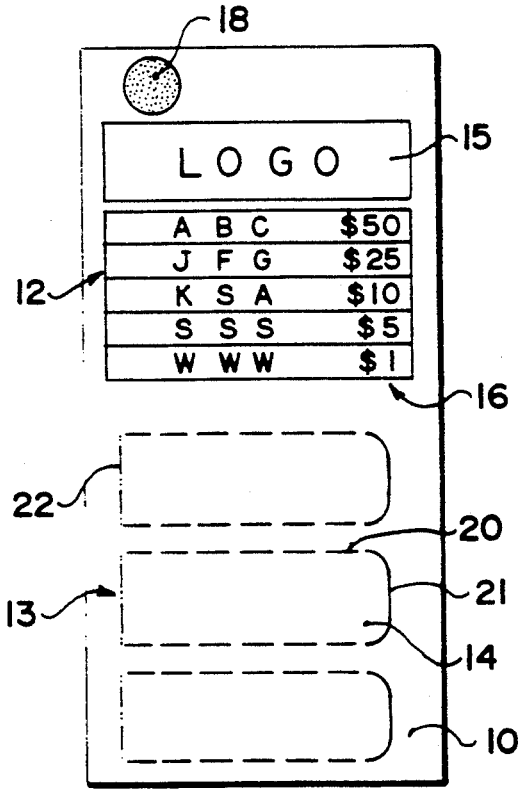
FIG. 1 is a front elevational view of the front face of one side of a game ticket according to the present invention.
Figure 2:
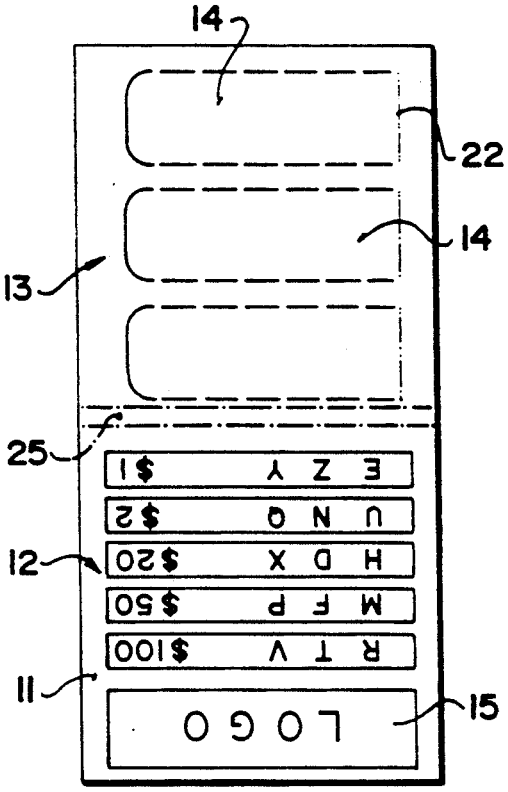
FIG. 2 is a front elevational view of the front face of the opposed side after rotation of the ticket of FIG. 1 about a vertical line.
Figure 3:
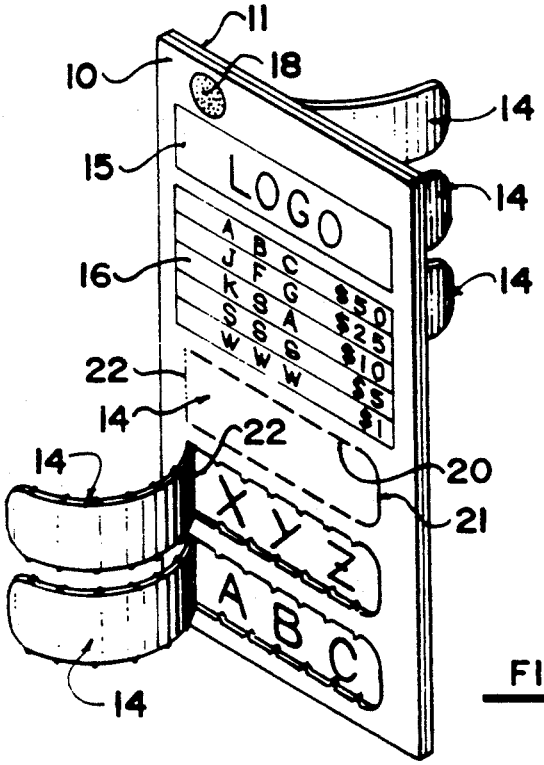
FIG. 3 is an isometric view of the ticket of FIGS. 1 and 2.

The game ticket shown in FIGS. 1, 2 and 3 comprises a first substrate 10 and a second substrate 11 both of which are planar, formed from a thick paper material and bonded together with the back face of one in contact with the back face of the other.

Each of the substrates 10 and 11 is generally of the same construction including an area 12 for receiving printed information and a second area 13 in which there is provided a plurality, in this case three, of break open panels 14.

The information area 12 includes a logo printed in an upper part as indicated at 15. The information area further includes a plurality of combinations of symbols indicated at 16. For convenience of illustration in FIG. 3, the symbols are indicated as letters. Thus for example in one line there are shown three symbols followed by a dollar value. This area is intended to indicate the combinations of symbols which constitute a winning combination. The symbols can be of various different types well known in the industry. The dollar values for the winning combinations will be calculated in accordance with regulations to provide a suitable number of winning tickets in combination with those tickets which have no winning combination and therefore losing tickets.

As shown in FIG. 1, the information area further includes an additional symbol 18 which is of a type obscured at the time of sale of the ticket by a coating of an opaque material which can be scratched away to reveal a symbol underneath the coating. This symbol can be used for security purposes so that an authorized person can simply determine that a ticket is a winning ticket by exposing the symbol. In this way tickets which have been fraudulently altered can be detected. The symbol 18 is characterized by the addition of the printed words "Void if Removed".

The second area 13 comprises the break open panels 14 each of which is rectangular in shape and is formed from a portion of the respective substrate. The panels are formed by the cutting of a perforated line 20 along two horizontal sides of the panel and at one end of the panel. At the end the cut line 21 is cut along the full height of the panel so that the user can simply grab an end tab portion of the panel at the cut end 21 to allow the panel to be torn along the sides 20 to a fold line of the panel. As shown in FIG. 3, the fold lines 22 lie along a common imaginary vertical line along one side edge of the ticket.

The rear face of each of the panels is covered by a dark preferably opaque layer to prevent viewing of the tickets using high power illumination projected through the ticket. The back face of the opposed substrate 11 as shown in FIG. 3 carries a printed series of symbols each underlying a respective one of the panels 14 so that the symbols can be viewed when the panels are opened. This combination of symbols is then compared with the winning combinations as set forth in the information section 12 to determine whether the ticket is a winning ticket or a losing ticket.

As shown in FIGS. 1 and 2, the ticket is rectangular with the vertical sides thereof longer than the horizontal sides with the information section 12 is provided in the approximately fifty percent area at the top of the ticket and the break open area 13 is provided in the approximately fifty percent constituting the bottom half of the ticket. The second substrate 11 shown in FIG. 2 is inverted relative to the first so that when the two substrates are bonded together, the information layer on the substrate 11 lies immediately adjacent and aligned with the break open area 13 of the substrate 10. Thus as shown in FIG. 3 the break open area of one substrate is completely separated from the break open area of the second substrate. Preferably a narrow strip 25 shown schematically in FIG. 2 by dot dash lines is provided between the break open areas 13 of one substrate and the second substrate so that even when the panels are fully opened, there is a thin strip 25 dividing the two areas.

The ticket thus provides the novelty effect of two separate games on one ticket which enhances the pleasure for the player and thus provides a possibility of significantly increased sales. At the same time the two separate games are entirely independant in that the game can be played on one side by opening the panels without in any way interfering with or exposing the symbols on the opposed side. The player therefore has the complete pleasure of playing the first game and then completely independantly playing the second game with each new tear open panel having the possibility of success, thus providing the gambling pleasure necessary to encourage the sales of such tickets.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A break open game ticket comprising a first planar substrate and a second planar substrate, the substrates being attached back face to back face so as to present front faces with the front face of one substrate being on one side of the ticket and the front face of the other substrate being on an opposed side of the ticket, each substrate having on the front face thereof a first area and a second area, the first area containing printed information defining those combinations of symbols which constitute a winning ticket, the second area containing a plurality of break open panels, each break open panel comprising a portion of the respective substrate which is separated from a remaining part of the substrate by tearable side edges allowing the panel to normally lie flat in a common plane of the substrate and to be manually torn open by a player of the game ticket to fold outwardly from the common plane, the first substrate being oriented and arranged relative to the second substrate such that the second area of the first substrate overlies the back face of the first area of the second substrate and such that the second area of the second substrate overlies the backface of the first area of the first substrate, the back face of the first area of each of the first and second substrates having printed thereon a plurality of combinations of symbols for viewing by the player of the game ticket, each combination being revealed by said tearing open of a respective one of the panels of the other of the first and second substrates.

2. The ticket according to claim 1 wherein the first area is provided at a top part of the respective front face and the second area is arranged at a bottom part of the respective front face underneath the top part and wherein the printed information on the front face of the first substrate is inverted relative to the printed information on the front face of the second substrate so that when viewed from the front each front face has substantially the same layout of the first area thereof relative to the second area thereof.

3. The ticket according to claim 2 wherein the first and second areas each constitute substantially fifty percent of the total area of the front face of the respective substrate.

4. The ticket according to claim 2 wherein the panels are arranged in a row such that they fold about a common imaginary line adjacent one side edge of the respective substrate.

5. The ticket according to claim 1 wherein the first and second areas each constitute substantially fifty percent of the total area of the front face of the respective substrate.

6. The ticket according to claim 1 wherein the panels of the second area are arranged in a row.

7. The ticket according to claim 1 wherein the panels are arranged in a row such that they fold about a common imaginary line adjacent one side edge of the respective substrate.

8. The ticket according to claim 1 wherein the front face of the first substrate carries an additional symbol thereon obscured by a scratch off layer and constituting a security symbol for the game ticket.

9. The ticket according to claim 1 wherein the back face of each of the substrates at the locations thereon comprising said panels thereof is coated with a dark opaque layer.

* * * * *